US006688540B1

(12) United States Patent
Passarella

(10) Patent No.: US 6,688,540 B1
(45) Date of Patent: Feb. 10, 2004

(54) POWER WASHER STANDOFF

(76) Inventor: Richard Nicholas Passarella, P.O. Box 112, Loretto, TN (US) 38469-0112

( * ) Notice: Subject to any disclaimer, the term of this patent is extended or adjusted under 35 U.S.C. 154(b) by 0 days.

(21) Appl. No.: 10/251,834

(22) Filed: Sep. 23, 2002

(51) Int. Cl.[7] ..... A62C 31/24; B05B 15/06; A46B 11/00; A46B 17/02

(52) U.S. Cl. ..... 239/280; 239/280.5; 401/48

(58) Field of Search ..... 239/280, 280.5, 239/281, 289, 532, 530; 401/48, 193, 137; 15/230.11; 285/236, 253; 403/362, 396, 385, 388

(56) References Cited

U.S. PATENT DOCUMENTS

| | | | | |
|---|---|---|---|---|
| 1,817,311 A | | 8/1931 | Hedde | |
| 2,520,397 A | | 8/1950 | Green | |
| 2,581,678 A | | 1/1952 | Malin et al. | |
| 3,423,027 A | * | 1/1969 | Small et al. | 239/754 |
| 3,508,709 A | | 4/1970 | Small et al. | |
| 4,022,382 A | | 5/1977 | Engdahl, Jr. | |
| 4,641,780 A | | 2/1987 | Smrt | |
| 4,892,251 A | | 1/1990 | Bresnen | |
| 5,340,026 A | | 8/1994 | Woodruff | |
| 5,653,392 A | | 8/1997 | Wells | |
| 5,937,628 A | | 8/1999 | Matechuk | |

* cited by examiner

*Primary Examiner*—Michael Mar
*Assistant Examiner*—Darren Gorman
(74) *Attorney, Agent, or Firm*—Lowe Hauptman Gilman & Berner, LLP

(57) ABSTRACT

A power washer standoff includes: a shaft holder arranged to be attached to a pole of a delivery wand of a power washer with a shaft holder fastener, the delivery wand having a nozzle with a tip disposed on one end of the pole thereof; a shaft having a straight portion and a bent portion; a roller attached to the bent portion of the shaft; and a shaft lock attached to the shaft holder, the shaft lock locking the shaft in the shaft holder in a fixed relationship with the pole upon the shaft being arranged within the shaft holder. The shaft is selectively adjustable within the shaft holder to adjust a relative position between the tip of the nozzle of the delivery wand and the roller such that the roller maintains the tip of the nozzle at a selected uniform distance from a surface to be washed by the power washer.

38 Claims, 2 Drawing Sheets

POWER WASHER STANDOFF

BACKGROUND OF THE INVENTION

1. Field of the Invention

The present invention relates to a power washer standoff and more particularly, the present invention relates to a power washer standoff including a roller-like device that is attached to a pole of a delivery wand of a power washer to maintain a uniform distance between the power washer nozzle and the surface being cleaned.

2. Description of the Related Art

Power washers, which consist of a water pump connected to a water source and a delivery wand having a nozzle, have become available in the past few years. These power washers allow a user to use a high-pressure water spray to clean various surfaces, such as wooden decks and aluminum siding.

Initially, power washers were only available as large expensive gasoline powered commercial arrangements that were unsuitable for use by the home handyman. However, recently, power washers have become available in many different sizes that have been specifically designed for use by the home handyman. Small commercial units are now also being offered.

Unfortunately, many new users, being unfamiliar with the strength of a high-pressure water spray, have encountered problems when using such power washers. Namely, when cleaning a wooden deck or the side of an automobile, if the user moves the nozzle of the delivery wand of the power washer too close to the deck or the side of an automobile, the surface of the wooden deck can be badly roughed up and the paint can actually be removed from the side of the automobile.

U.S. Pat. No. 5,653,392 to Wells discloses a water spray apparatus for use in cleaning ground surfaces. As illustrated in FIG. 7 thereof, cross tubes 64 contain a plurality of nozzles for spraying a ground surface. Wheels 66 and 68 keep the nozzles at a uniform distance from the ground surface. However, the only way to change the distance between the nozzles and the ground surface is to change the wheels 66 and 68 to wheels of other diameters. Furthermore, the apparatus of Wells does not teach or suggest to consider the use of a hand-held delivery wand having a single nozzle, such as that used in most power washers in use today.

U.S. Pat. No. 4,892,251 to Bresnen discloses a line-marking device in which the single nozzle can be adjusted so as to be closer to or further away from the surface to be marked. However, Bresnen does not teach or suggest that its arrangement is to be used as a power washer. Furthermore, the so-called wand of Bresnen is attached to a wheeled apparatus 100 so as to be moved along the ground rather than using a hand-held delivery wand used in most power washers in use today.

In view of the above, there is an unfulfilled need for a power washer standoff that is attached to a delivery wand of a power washer to maintain a uniform distance between the power washer nozzle and the surface being cleaned.

SUMMARY OF THE INVENTION

It is accordingly an object of the present invention to provide a simple inexpensive power washer standoff that may easily be attached to a delivery wand of a power washer to maintain a uniform distance between the power washer nozzle and the surface being cleaned.

These and other objects of the present invention may be achieved by providing a power washer standoff having a shaft holder with a shaft lock arranged to be attached to a pole of a delivery wand of a power washer and having a shaft with a roller device attached to an end thereof, the shaft being arranged so as to be held by the shaft holder, wherein upon arranging the shaft with a roller device so as to be held by the shaft holder and locked by the shaft lock, the roller maintains a uniform distance between the power washer nozzle and the surface being cleaned.

BRIEF DESCRIPTION OF THE DRAWINGS

The foregoing and a better understanding of the present invention will become apparent from the following detailed description of an example embodiment and the claims when read in connection with the accompanying drawings, all forming a part of the disclosure of this invention. While the foregoing and following written and illustrated disclosure focuses on disclosing an example embodiment of the invention, it should be clearly understood that the same is by way of illustration and example only and that the invention is not limited thereto. This spirit and scope of the present invention are limited only by the terms of the appended claims.

DETAILED DESCRIPTION

Figure 1:
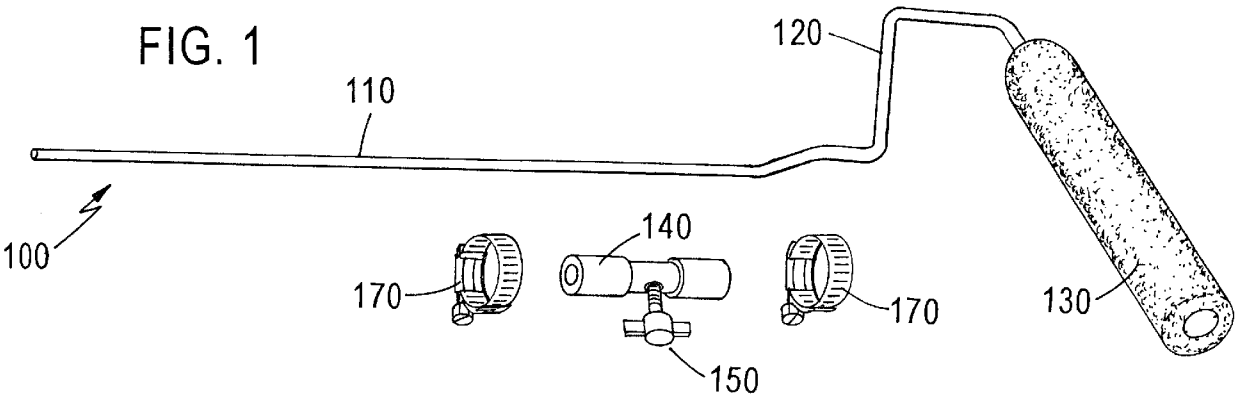
FIG. 1 is a view of unassembled elements of a power washer standoff in accordance with an example embodiment of the present invention.

Before beginning a detailed description of the subject invention, mention of the following is in order. When appropriate, like reference numerals and characters may be used to designate identical, corresponding, or similar components in differing drawing figures. Furthermore, in the detailed description to follow, example sizes/models/value/ranges may be given, although the present invention is not limited thereto. When specific details are set forth in order to describe example embodiment of the invention, it should be apparent to one skilled in the art that the invention can be practiced without, or with variations of, these specific details.

As illustrated in FIG. 1, the elements of a power washer standoff in accordance with an example embodiment of the present invention included a shaft 100 having a straight portion 110 and a bent portion 120. A roller 130 is affixed to the end of the bent portion 120 of the shaft 100. A shaft holder 140 includes a shaft lock 150. A pair of adjustable hose clamps 170 serves as a shaft holder fastener to fasten the shaft holder 140 to a pole of a delivery wand (not shown) of a power washer.

Figure 2:
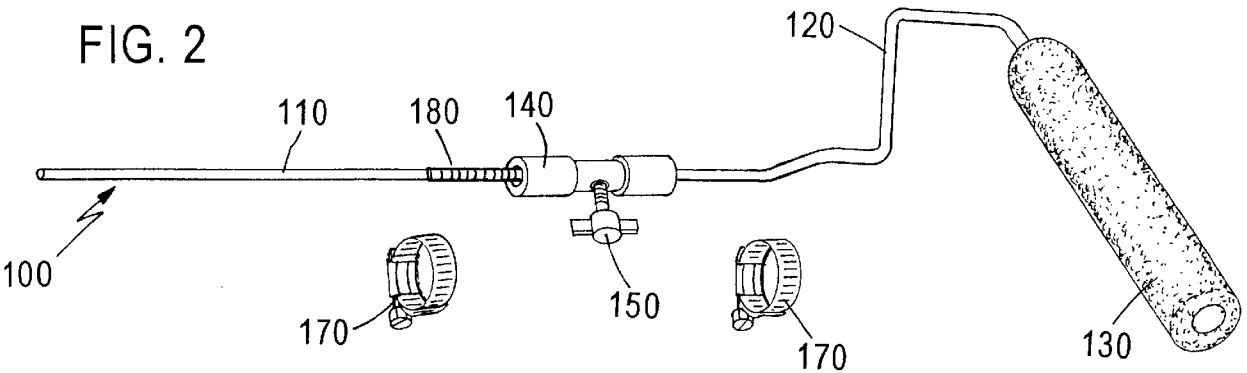
FIG. 2 is a view of the partially assembled elements of a power washer standoff in accordance with an example embodiment of the present invention.

FIG. 2 illustrates the elements of FIG. 1 with the straight portion 110 of the shaft 100 being held by the shaft holder 140. The straight portion 110 of the shaft 100 in this drawing figure includes an optional distance measurement indicator 180 that, as discussed below, will be used to adjust the shaft 100 so that the nozzle of the delivery wand of the power washer will be at a fixed predetermined distance from the surface to be cleaned.

Figure 3:
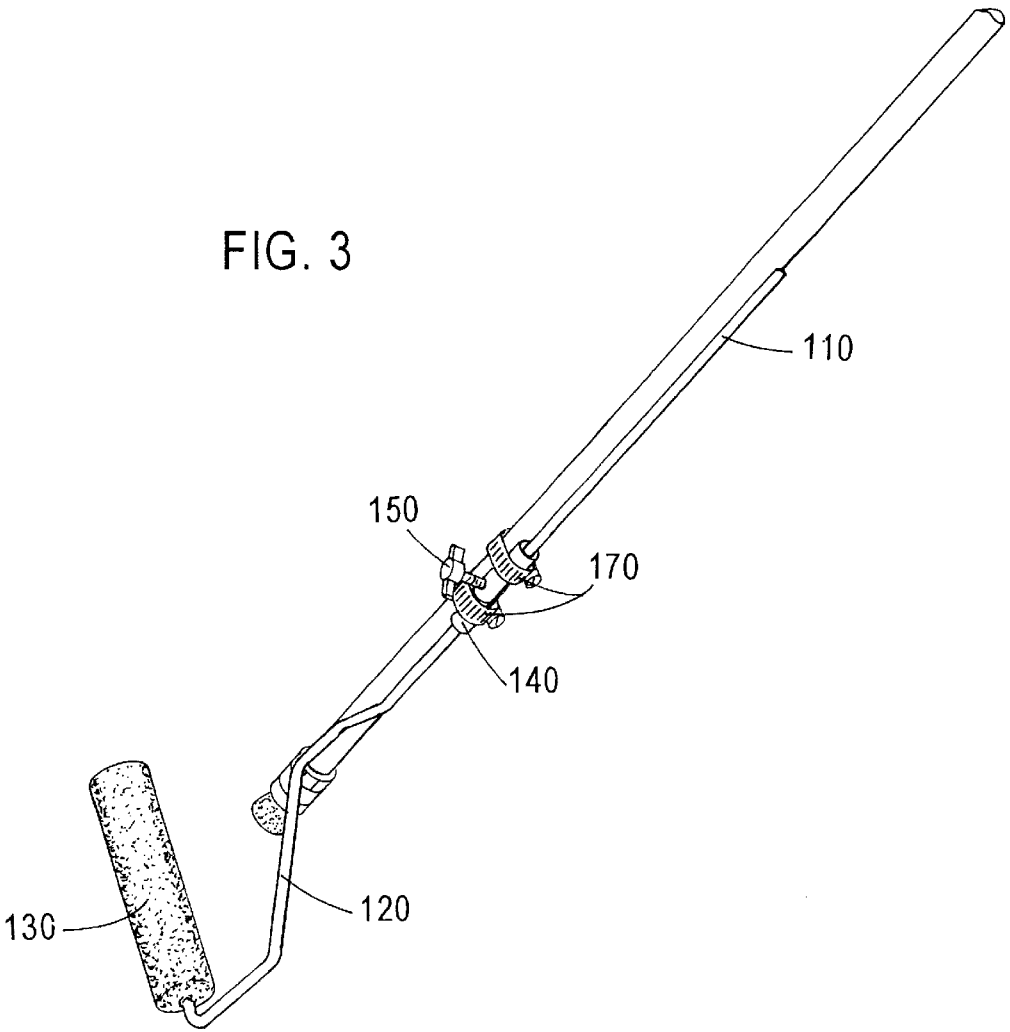
FIG. 3 is a view of an assembled power washer standoff in accordance with an example embodiment of the present invention.

FIG. 3 illustrates the elements of FIG. 2 after being fully assembled. The shaft 100 is held by the shaft holder 140 and prevented from moving by the shaft lock 150. The pair of adjustable hose clamps 170, serving as shaft holder fasteners, fasten the shaft holder 140 to the pole of the delivery wand 300 of a power washer (not shown).

If the optional distance measurement indicator 180 is available to be used, it can be easily calibrated by locking the shaft 100 in the shaft holder 140 with the shaft lock 150 so that the indicator 180 is set equal to 0 and then attaching the shaft holder 140 to the pole of the delivery wand 300 of the power washer so that the roller 130 and the tip of the nozzle of the pole of the delivery wand 300 both just touch the same flat surface.

Alternatively, if no optional distance measurement indicator 180 is available to be used, the shaft holder 140 is attached to the delivery wand 300 of the power washer and the shaft 100 is then adjusted with respect to the shaft holder 140 so that the tip of the nozzle of the pole of the delivery wand 300 is a desired distance away from a flat surface when the roller 130 is touching the flat surface.

The user of the power washer can then operate the power washer and move the hand-held pole of the delivery wand 300 without fear of moving the nozzle of the pole of the delivery wand 300 too close to the surface being cleaned, thereby ensuring that the surface being cleaned is not damaged by the power washer.

While the shaft 100 has been illustrated as being a unitary structure having a straight portion 110 and a bent portion 120, the present invention is not limited thereto. A shaft 100 having a straight portion 110 and a separate bent portion 120 attached thereto is also a possibility. The cross-section of the two portions of the shaft 100 is not limited to the circular cross-section illustrated in the drawing figures but rather may be any suitable cross-section.

Furthermore, the exact shape of the bent portion 120 does not necessarily have to conform with that illustrated in the drawing figures but rather, the bent portion merely has to ensure that the roller 130 is at a selected angle with respect to the straight portion of the shaft 100, the selected angle being 90 degrees in the illustrative embodiment but not limited thereto in the present invention.

Still furthermore, the details of the shaft holder 140 and shaft lock 150 did not necessarily have to conform with that illustrated in the drawing figures, but rather can be of any configuration that can firmly hold the shaft 100 in place after adjustment of the position of the roller with respect to the tip of the nozzle of the pole of the delivery wand 300.

The shaft holder fasteners are not limited to the pair of adjustable hose clamps 170 shown in the drawing figures but may be any fasteners capable of easily attaching the shaft holder 140 to the pole of the delivery wand 300 of the power washer.

Lastly, the shape of the roller 130 is not limited to that illustrated in the drawing figures but rather can be any suitable roller shape.

This concludes the description of the example embodiment. Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangements within the scope of the foregoing disclosure, the drawings, and the appended claims without departing from the spirit of the invention. In additions to variations and modifications in the component parts and/or arrangements, alternative uses will also be apparent to those skilled in the art.

What is claimed is:

1. A power washer standoff comprising:

a shaft holder arranged to be attached to a pole of a delivery wand of a power washer with a shaft holder fastener, the delivery wand having a nozzle with a tip disposed on one end of said pole thereof;

a shaft having a straight portion and a bent portion;

a roller attached to said bent portion of said shaft; and a shaft lock attached to said shaft holder, said shaft lock locking said shaft in said shaft holder in a fixed relationship with said pole upon said shaft being arranged within said shaft holder;

wherein said shaft is selectively adjustable within said shaft holder to adjust a relative position between said tip of said nozzle of said delivery wand and said roller such that said roller maintains said tip of said nozzle at a selected uniform distance from a surface to be washed by said power washer;

wherein said shaft holder comprises an aperture arranged to receive said straight portion of said shaft; and wherein said shaft lock comprises a selectively movable pin disposed at substantially a 90 degree angle with respect to an axis of said aperture of said shaft holder, said movable pin being urged inward toward said axis of said aperture of said shaft holder to contact said straight portion of said shaft, thereby locking said shaft with respect to said shaft holder.

2. The power washer standoff of claim 1, wherein said shaft holder is arranged to position said straight portion of said shaft so as to be substantially parallel to said pole of said delivery wand.

3. The power washer standoff of claim 1, wherein said bent portion of said shaft is arranged to position said roller so as to have its axis of revolution at a specified angle with respect to an axis of said straight portion of said shaft.

4. The power washer standoff of claim 3, wherein said specified angle is 90 degrees.

5. The power washer standoff of claim 2, wherein said bent portion of said shaft is arranged to position said roller so as to have its axis of revolution at a specified angle with respect to an axis of said straight portion of said shaft.

6. The power washer standoff of claim 5, wherein said specified angle is 90 degrees.

7. The power washer standoff of claim 1, further comprising a measurement indicator located on said straight portion of said shaft, said measurement indicator indicating said selected distance from said tip of said nozzle to said surface to be washed by said power washer.

8. The power washer standoff of claim 1, wherein said selectively movable pin comprises a threaded portion arranged to mate with a threaded portion of said shaft holder and a handle portion disposed on an end of said movable pin to facilitate rotating said movable pin with respect to said shaft holder, thereby selectively moving said pin linearly with respect to said shaft holder.

9. The power washer standoff of claim 1, wherein said shaft holder fastener comprises at least two adjustable hose clamps arranged to encompass said shaft holder and said pole of said delivery wand, thereby fixing said shaft holder to said pole of said delivery wand.

10. A method of maintaining a tip of a nozzle of a delivery wand of a power washer at a selected uniform distance from a surface to be washed by the power washer, the method comprising:

attaching a shaft holder to a pole of the delivery wand of the power washer with a shaft holder fastener, the delivery wand having the nozzle with the tip disposed on one end of the pole thereof;

inserting a shaft having a straight portion and a bent portion in the shaft holder;

attaching a roller to the bent portion of the shaft; and locking the shaft in the shaft holder in a fixed relationship with the pole with a shaft lock upon the shaft being arranged within the shaft holder;

wherein the shaft is selectively adjustable within the shaft holder to adjust a relative position between the tip of the nozzle of the delivery wand and the roller such that the roller maintains the tip of the nozzle at the selected uniform distance from the surface to be washed by the power washer; to be washed by the power washer; and further comprising disposing an aperture within the shaft holder to receive the straight portion of said shaft; and providing the shaft lock with a selectively movable pin disposed at substantially a 90 degree angle with respect to an axis of the aperture of the shaft holder, the movable pin being urged inward toward the axis of the aperture of the shaft holder to contact the straight portion of the shaft, thereby locking the shaft with respect to the shaft holder.

11. The method of claim 10, further comprising positioning the straight portion of the shaft within the shaft holder so as to be substantially parallel to the pole of the delivery wand.

12. The method of claim 10, further comprising positioning the bent portion of the shaft to position the roller so as to have its axis of revolution at a specified angle with respect to an axis of the straight portion of the shaft.

13. The method of claim 12, wherein said specified angle is 90 degrees.

14. The method of claim 11, further comprising positioning the bent portion of said shaft to position the roller so as to have its axis of revolution at a specified angle with respect to an axis of the straight portion of the shaft.

15. The method of claim 14, wherein said specified angle is 90 degrees.

16. The method of claim 10, further comprising disposing a measurement indicator on the straight portion of said shaft, the measurement indicator indicating the selected distance from the tip of the nozzle to the surface.

17. The method of claim 10, further comprising providing the selectively movable pin with a threaded portion arranged to mate with a threaded portion of the shaft holder and a handle portion disposed on an end of the movable pin to facilitate rotating in the movable pin with respect to the shaft holder, thereby selectively moving the pin linearly with respect to the shaft holder.

18. The method of claim 10, further comprising providing the shaft holder fastener with at least two adjustable hose clamps arranged to encompass the shaft holder and the pole of the delivery wand, thereby fixing the shaft holder to the pole of the delivery wand.

19. A power washer standoff comprising:

a shaft holder arranged to be attached to a pole of a delivery wand of a power washer with a shaft holder fastener, the delivery wand having a nozzle with a tip disposed on one end of said pole thereof;

a shaft having a straight portion and a bent portion;

a roller attached to said bent portion of said shaft; and a shaft lock attached to said shaft holder, said shaft lock locking said shaft in said shaft holder in a fixed relationship with said pole upon said shaft being arranged within said shaft holder;

wherein said shaft is selectively adjustable within said shaft holder to adjust a relative position between said tip of said nozzle of said delivery wand and said roller such that said roller maintains said tip of said nozzle at a selected uniform distance from a surface to be washed by said power washer;

wherein said shaft holder fastener comprises at least two adjustable hose clamps arranged to encompass said shaft holder and said pole of said delivery wand, thereby fixing said shaft holder to said pole of said delivery wand.

20. The power washer standoff of claim 19, wherein said shaft holder is arranged to position said straight portion of said shaft so as to be substantially parallel to said pole of said delivery wand.

21. The power washer standoff of claim 19, wherein said bent portion of said shaft is arranged to position said roller so as to have its axis of revolution at a specified angle with respect to an axis of said straight portion of said shaft.

22. The power washer standoff of claim 21, wherein said specified angle is 90 degrees.

23. The power washer standoff of claim 20, wherein said bent portion of said shaft is arranged to position said roller so as to have its axis of revolution at a specified angle with respect to an axis of said straight portion of said shaft.

24. The power washer standoff of claim 23, wherein said specified angle is 90 degrees.

25. The power washer standoff of claim 19, further comprising a measurement indicator located on said straight portion of said shaft, said measurement indicator indicating said selected distance from said tip of said nozzle to said surface to be washed by said power washer.

26. The power washer standoff of claim 19, wherein said shaft holder comprises an aperture arranged to receive said straight portion of said shaft.

27. The power washer standoff of claim 26, wherein said shaft lock comprises a selectively movable pin disposed at substantially a 90 degree angle with respect to an axis of said aperture of said shaft holder, said movable pin being urged inward toward said axis of said aperture of said shaft holder to contact said straight portion of said shaft, thereby locking said shaft with respect to said shaft holder.

28. The power washer standoff of claim 27, wherein said selectively movable pin comprises a threaded portion arranged to mate with a threaded portion of said shaft holder and a handle portion disposed on an end of said movable pin to facilitate rotating said movable pin with respect to said shaft holder, thereby selectively moving said pin linearly with respect to said shaft holder.

29. A method of maintaining a tip of a nozzle of a delivery wand of a power washer at a selected uniform distance from a surface to be washed by the power washer, the method comprising:

attaching a shaft holder to a pole of the delivery wand of the power washer with a shaft holder fastener, the delivery wand having the nozzle with the tip disposed on one end of the pole thereof;

inserting a shaft having a straight portion and a bent portion in the shaft holder;

attaching a roller to the bent portion of the shaft; and locking the shaft in the shaft holder in a fixed relationship with the pole with a shaft lock upon the shaft being arranged within the shaft holder;

wherein the shaft is selectively adjustable within the shaft holder to adjust a relative position between the tip of the nozzle of the delivery wand and the roller such that the roller maintains the tip of the nozzle at the selected uniform distance from the surface to be washed by the power washer; and further comprising providing the shaft holder fastener with at least two adjustable hose clamps arranged to encompass the shaft holder and the pole of the delivery wand, thereby fixing the shaft holder to the pole of the delivery wand.

30. The method of claim 29, further comprising positioning the straight portion of the shaft within the shaft holder so as to be substantially parallel to the pole of the delivery wand.

31. The method of claim 29, further comprising positioning the bent portion of the shaft to position the roller so as to have its axis of revolution at a specified angle with respect to an axis of the straight portion of the shaft.

32. The method of claim 31, wherein said specified angle is 90 degrees.

33. The method of claim 30, further comprising positioning the bent portion of said shaft to position the roller so as to have its axis of revolution at a specified angle with respect to an axis of the straight portion of the shaft.

34. The method of claim 33, wherein said specified angle is 90 degrees.

35. The method of claim 29, further comprising disposing a measurement indicator on the straight portion of said shaft, the measurement indicator indicating the selected distance from the tip of the nozzle to the surface to be washed by the power washer.

36. The method of claim 29, further comprising disposing an aperture within the shaft holder to receive the straight portion of said shaft.

37. The method of claim 36, further comprising providing the shaft lock with a selectively movable pin disposed at substantially a 90 degree angle with respect to an axis of the aperture of the shaft holder, the movable pin being urged inward toward the axis of the aperture of the shaft holder to contact the straight portion of the shaft, thereby locking the shaft with respect to the shaft holder.

38. The method of claim 37, further comprising providing the selectively movable pin with a threaded portion arranged to mate with a threaded portion of the shaft holder and a handle portion disposed on an end of the movable pin to facilitate rotating in the movable pin with respect to the shaft holder, thereby selectively moving the pin linearly with respect to the shaft holder.

* * * * *